US006397707B1

(12) United States Patent
Tatarinov

(10) Patent No.: US 6,397,707 B1
(45) Date of Patent: Jun. 4, 2002

(54) EJECTOR EXTENSION II

(76) Inventor: Dmitri Vallerveich Tatarinov, 5790 Friars Rd. F8, San Diego, CA (US) 92110

( * ) Notice: Subject to any disclaimer, the term of this patent is extended or adjusted under 35 U.S.C. 154(b) by 0 days.

(21) Appl. No.: 09/723,271

(22) Filed: Nov. 28, 2000

Related U.S. Application Data

(63) Continuation-in-part of application No. 09/500,050, filed on Feb. 8, 2000.
(60) Provisional application No. 60/164,263, filed on Nov. 9, 1999.

(51) Int. Cl.[7] ..... B25B 13/00
(52) U.S. Cl. ..... 81/124.1; 81/125
(58) Field of Search ..... 81/121.1, 124.1, 81/125, 177.2

(56) References Cited

U.S. PATENT DOCUMENTS 2,470,399 A * 5/1949 Holben ..... 81/124.1
3,224,302 A * 12/1965 Cooley, Sr. ..... 81/124.1
5,163,345 A * 11/1992 Doan et al. ..... 81/125
5,249,489 A * 10/1993 Weisman ..... 81/125
5,568,757 A * 10/1996 Lewis ..... 81/177.2
5,690,006 A * 11/1997 Pulliam ..... 81/177.2

* cited by examiner

*Primary Examiner*—Joseph J. Hail, III
*Assistant Examiner*—Joni B. Danganan

(57) ABSTRACT

A tool capable of extending the reach of a socket containing an ejector mechanism that is capable of holding a nut, screw or bolt (hereafter called a fastening device) within a socket by magnetism. Said tool will also be capable of ejecting the fastening device from the socket chamber. The tool is also capable of being attached to different size sockets. The tool may be attached to a ratchet device. The tool is composed of a cylindrical shaft containing a metal shank inside of a lesser diameter. They cylindrical shaft has a square opening on one end and an extruding square nodule on the opposite end. The metal shank has a magnet attached to one end and a spring coil located at the opposite end. On the outside of the cylindrical shank is a metal sleeve of a greater diameter surrounding the middle portion of the cylindrical shaft. When the metal sleeve is manually pulled the inner spring coil is activated pushing the metal shank out the square opening on one end of the cylindrical shaft, inserting the metal shank into the bottom of the attached socket thereby ejecting the fastening device from the attached socket for manual removal. The extruding square end of the cylindrical shaft allows the attachment of different sized sockets. The cylindrical shaft end containing the square opening allows the attachment of a ratchet device.

1 Claim, 3 Drawing Sheets

EJECTOR EXTENSION II

CROSS-REFERENCES TO RELATED APPLICATIONS

This application is a continuation-in-part of copending application, Ser. No. 09/500,050 filed Feb. 8, 2000, (originally filed application Ser. No. 60/164,263 filed Nov. 9, 1999). Application Ser. No. 09/500,050 is still pending.

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

This invention relates to tools which are used to attach and detach fastening devices (nuts, screws, bolts etc) by the use of a socket. Specifically this tool is a device which utilizes an ejector mechanism with a magnetic head within an extension that fits different sizes of sockets and the use of a ratchet tool to remove stuck or jammed fastening devices within a socket.

A number of attempts have been made to provide for devices for ejecting fastening devices but the previous mechanisms related to my invention are not adaptable to different size socket attachments or capable of being used as an extension tool, or capable of being attached to a ratchet.

U.S. Pat. No. 2,470,399, issued May 17, 1949 to Holben, describes an ejector type socket wrench. The wrench of this invention describes a permanent socket at one end for receiving a nut to be turned. Inside the shank assembly is a spring returned plunger rod attached to a spring and a finger piece projecting through a side slot in the shank which ejects the nut from the socket.

U.S. Pat. No. 3,224,302, issued Dec. 21, 1965 to Cooley, describes a socket wrench with a nut ejector. The wrench of this invention describes an elongated sleeve having a permanent socket at one end for receiving a nut to be turned. Inside the elongated sleeve is a nut ejector rod which when activated by pushing a button, ejects a nut.

U.S. Pat. No. 5,163,345, issued Nov. 17, 1992 to Doan, describes a spring-loaded nut driver with a socket coupled to one end for receiving an associated rotatable fastener. The spring-loaded element is magnetic for holding the driven member in engagement with the tool.

U.S. Pat. No. 5,249,489, issued Sep. 4, 1992 to Weisman, describes a nut ejecting socket insert. This tool is composed of a magnet and compression spring assembly which is inserted into a socket.

U.S. Pat. No. 5,437,211, issued Aug. 1, 1995 to Wolfe, describes an apparatus for ejecting nuts from sockets and a method of installation in a socket. The ejecting apparatus is inserted into existing wrench sockets.

The first three ejecting devices are not adaptable to different fastening device sizes. Each ejecting device socket is a permanent part of the device and the devices are not capable of adaption to different size sockets or ratchet use.

The last two devices are actually inserted into a socket For different socket size use, the apparatus must be removed and reinstalled into a new socket.

Accordingly, it is a principal object of the present invention to provide a tool that allows the use of different sized sockets for fastening devices, to be easily attached to an extension unit containing a fastening device magnetic ejector and a ratchet attachment.

Other objects of the present invention, as well as particular features, elements, and advantages thereof will be apparent from the following description and the accompanying drawing figures.

BRIEF SUMMARY OF THE INVENTION

The objective of the present invention is provide a tool that will eject fastening devices from a socket head, provide a tool that will magnetically hold fastening devices inside a socket head, provide a tool which is capable of being used with different sized sockets, provide a tool that may be used with a ratchet device, and provide an extension tool for sockets.

The device of my invention comprises a socket extension containing an magnetic ejector unit with a socket attachment on one end and a ratchet attachment on the other end.

BRIEF DESCRIPTION OF THE SEVERAL VIEWS OF THE DRAWING(S)

DETAILED DESCRIPTION OF THE DRAWING

Figures 1A, 1B:
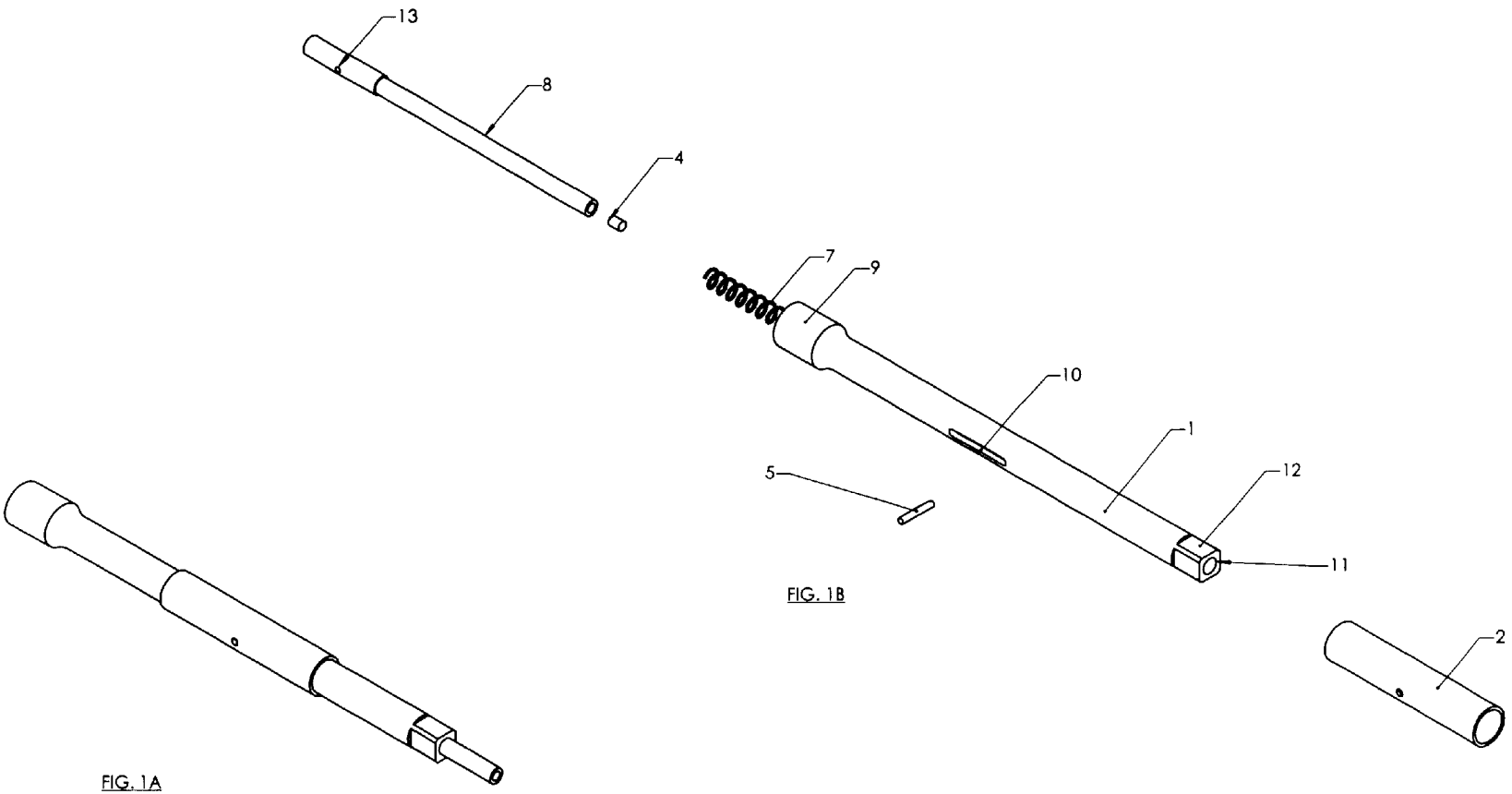
FIG. 1 shows the component pieces of the present invention and will help to facilitate the understanding of the present invention and is not intended to limit the scope of the invention.

FIG. 1 shows the component pieces of the present invention and will help to facilitate the understanding of the present invention and is not intended to limit the scope of the invention. Reference is now made to the individual component pieces in FIG. 1. 1 extension body of the invention, the cylindrical shaft containing the ejector mechanism. The extruding square nodule end 12 is the extension socket head attachment. The round hole located in the extruding square nodule end 12 (extension socket head attachment) is the ejector plunger exit hole 11 of the ejector extension. The opposite rounded end 9, the ratchet attachment end, of the extension body 1 contains a square opening for a ratchet to be attached. Located in the mid section of the extension body 1 is the ejector extension slot 10 for a set screw 5 to engage or disengage the ejector plunger assembly 8. 2 is the handle, a sleeve which slides over the extension body 1 and is held in place by the set screw 5. When the circular sleeve handle 2 is manually pushed toward the extension socket head attachment end 12, the ejector plunger assembly 8 is pushed through the extension body 1 and the end of the ejector plunger assembly 8 is projected through the ejector plunger exit hole 11 of the extension body 1. Item 7, the ejector mechanism spring, is activated by manually pushing the circular sleeve handle 2 towards the extension socket head attachment end 12. The ejector mechanism spring 7 is held in place within the extension body 1 by an interior lip and the larger end of the ejector plunger assembly 8. Located on the larger end of the ejector plunger assembly 8 is the ejector plunger set screw hole 13 for the set screw 5. When the present invention is put together, the set screw 5, slides through the extension body's 1 ejector extension slot 10 and is connected to the ejector plunger assembly 8 by attaching the set screw 5 through the ejector plunger set screw hole 13. When the circular sleeve handle 2 is pushed the setscrew 5moves the ejector plunger assembly 8 along the ejector extension slot 10 and the magnetized end 4 of the ejector plunger assembly 8 is manually pushed through the ejector plunger exit hole 11 of the extension body 1.

Figure 2A:
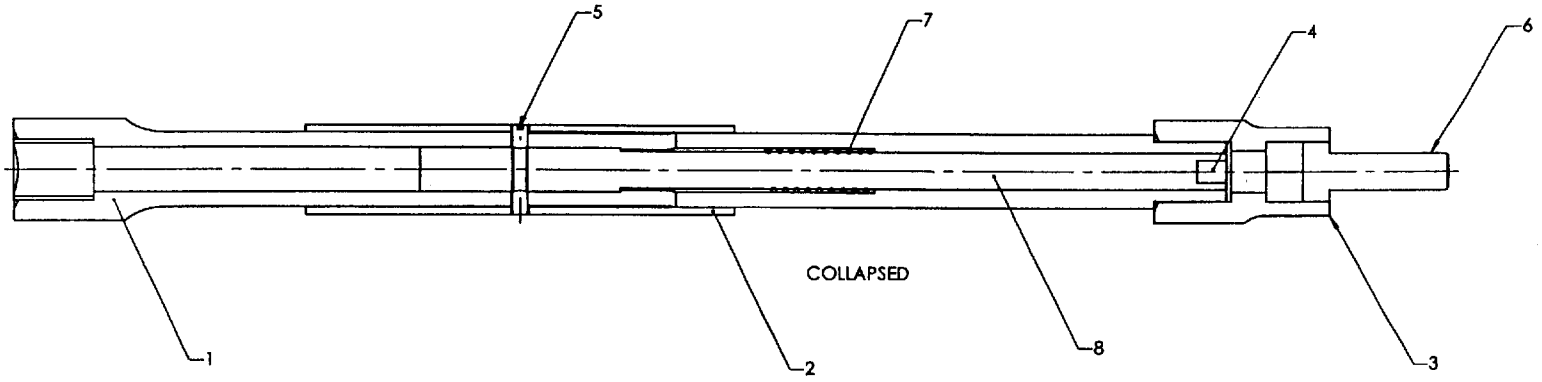
FIG. 2 shows the exterior side view and cross view of the present invention with the ejector plunger assembly unejected.
Figure 2B:
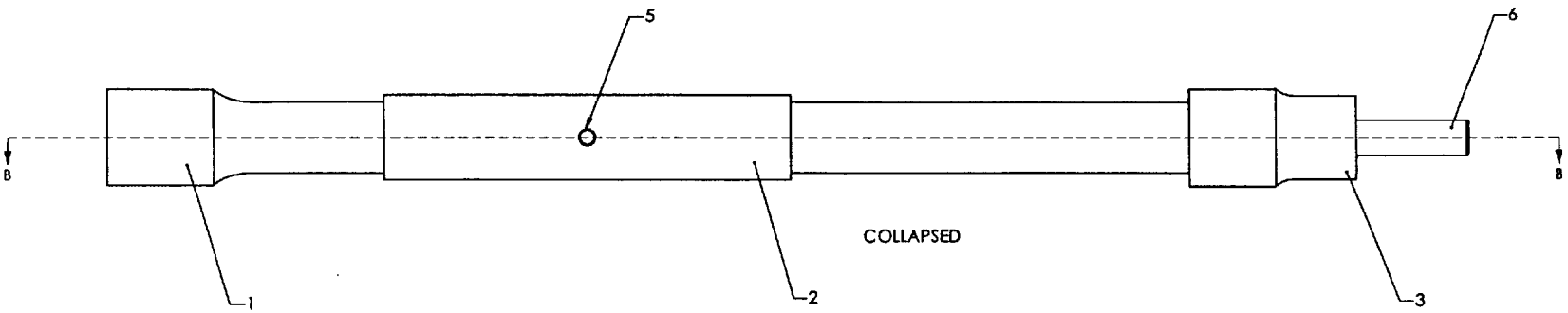

FIG. 2. shows the exterior side view and cross view of the present invention with the ejector plunger assembly 8 unejected. The extension body 1, the cylindrical shaft containing the ejector plunger assembly 8, completely surrounds the ejector plunger assembly 8. The circular sleeve handle 2, is attached through the ejector extension body 1 to the ejector plunger assembly 8 by the set screw 5. The ejector mechanism spring 7 surrounding a portion of the ejector plunger assembly 8 is at rest. A socket 3 has been attached to the extension socket head attachment 12. A bolt 6 has been inserted into the socket 3.

Figure 3A:
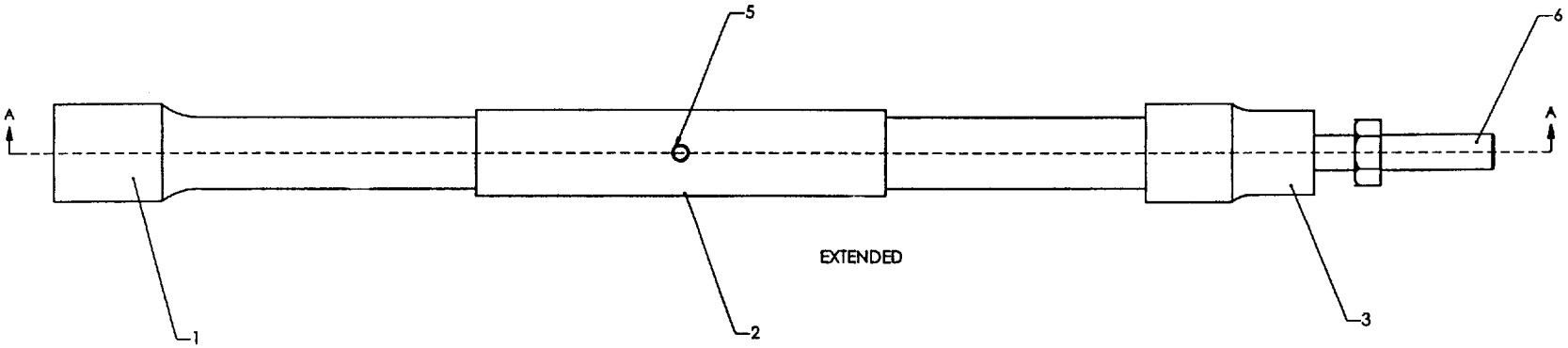
FIG. 3 shows the exterior side view and cross view of the present invention with the ejector plunger assembly ejected
Figure 3B:
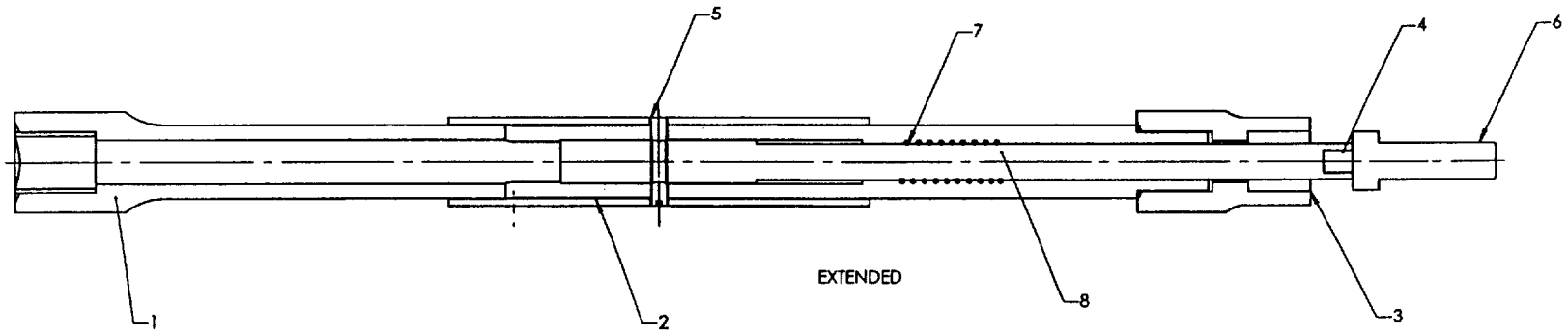

FIG. 3. shows the exterior side view and cross view of the present invention with the ejector plunger assembly 8 ejected. The extension body 1, the cylindrical shaft containing the ejector plunger assembly 8, surrounds the majority of the ejector plunger assembly 8. The magnetized end 4 extends out through the end of the socket 3 pushing the bolt 6 free of the socket head 3. The circular sleeve handle 2, is attached through the ejector extension body 1 to the ejector plunger assembly 8 by the set screw 5. The circular sleeve handle 2 has been pushed toward the extension socket head attachment compressing the ejector mechanism spring 7 causing the ejector plunger assembly 8 to exit the extension body 1 through the ejector plunger exit hole 11 and through the socket 3 pushing out the bolt 6. The bolt 6 has been unjammed from the interior of the socket 3.

1. extension body—cylindrical shaft containing the ejector assembly

2. circular sleeve handle

3. socket

4. magnetized end

5. set screw

6. bolt or other fastening device

7. ejector mechanism spring

8. ejector plunger assembly

9. ratchet attachment end

10. ejector extension slot

11. ejector plunger exit hole

12. Extension socket head attachment

13. ejector plunger set screw hole

We claim:

1. An ejector extension apparatus for use with a socket comprising:

an extension body having first and second ends, a square socket head attachment on the first end and a recessed square ratchet attachment on the second end; the extension body having a bore extending from the first end to the second end and a slot in the middle of the extension body extending from an outer surface of the extension body to the bore;

a spring-biased ejector shaft slidably engaged within the extension body bore, the ejector shaft including a magnet on a first end and a transverse bore in the middle of the ejector shaft;

a cylindrical sleeve moveable on the outer surface of the extension body; and a set screw connecting the sleeve, ejector shaft and extension body; the set screw extending through the sleeve, the transverse bore of the ejector shaft and the slot of the extension body such that the first end of the ejector shaft is movable between a position within the extension body and a position extending from the first end of the extension body by moving the sleeve relative to the extension body.

* * * * *